US007548018B2

(12) United States Patent
Lee

(10) Patent No.: US 7,548,018 B2
(45) Date of Patent: Jun. 16, 2009

(54) ELECTRON EMISSION DEVICE WITH A GRID ELECTRODE FOR FOCUSING ELECTRON BEAMS

(75) Inventor: Seung-Hyun Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 293 days.

(21) Appl. No.: 11/212,836

(22) Filed: Aug. 25, 2005

(65) Prior Publication Data

US 2007/0236132 A1 Oct. 11, 2007

(30) Foreign Application Priority Data

Aug. 30, 2004 (KR) ..... 10-2004-0068573

(51) Int. Cl.
*H01J 1/30* (2006.01)
*H01J 9/02* (2006.01)

(52) U.S. Cl. ..... 313/497; 313/495; 313/496; 313/309; 313/310; 315/169.3; 445/24

(58) Field of Classification Search ..... 313/495–497, 313/293–304; 315/169.3
See application file for complete search history.

(56) References Cited

U.S. PATENT DOCUMENTS 5,578,900 A * 11/1996 Peng et al. ..... 313/495
6,181,060 B1 * 1/2001 Rolfson ..... 313/495
6,563,260 B1 * 5/2003 Yamamoto et al. ..... 313/495
6,617,798 B2 * 9/2003 Lee et al. ..... 315/169.3
6,683,415 B1 * 1/2004 Compain et al. ..... 315/168
2003/0001490 A1 * 1/2003 Yamamoto et al. ..... 313/495
2004/0135490 A1 * 7/2004 Lee et al. ..... 313/495
2004/0227452 A1 * 11/2004 Lee et al. ..... 313/495
2005/0077813 A1 * 4/2005 Lee ..... 313/495
2005/0082964 A1 * 4/2005 Konishi ..... 313/497
2005/0140268 A1 * 6/2005 Lee et al. ..... 313/495
2005/0264165 A1 * 12/2005 Ryu ..... 313/495
2006/0033414 A1 * 2/2006 Ahn ..... 313/293

FOREIGN PATENT DOCUMENTS

JP 09274845 A * 10/1997

OTHER PUBLICATIONS

Machine English translation of JP09274845A.*
Official English translation of JP 09274845 to Hosoya.*

* cited by examiner

*Primary Examiner*—Sikha Roy
(74) *Attorney, Agent, or Firm*—Christie, Parker & Hale, LLP

(57) ABSTRACT

An electron emission device includes first and second substrates facing each other while a vacuum space is interposed therebetween. An electron emission array is formed on the first substrate to emit electrons toward the second substrate, and phosphor layers are formed on the second substrate. An anode electrode is formed on a surface of the phosphor layers, and receives the voltage required for accelerating electron beams from the electron emission array. A grid electrode is disposed between the first and second substrates and is closer to the second substrate than to the first substrate. The grid electrode has electron beam passage holes, and receives a voltage lower than a location reference voltage.

13 Claims, 4 Drawing Sheets

ELECTRON EMISSION DEVICE WITH A GRID ELECTRODE FOR FOCUSING ELECTRON BEAMS

CROSS REFERENCE TO RELATED APPLICATION

This application claims priority to and the benefit of Korean Patent Application No. 10-2004-0068573 filed on Aug. 30, 2004 in the Korean Intellectual Property Office, the entire content of which is incorporated herein by reference.

BACKGROUND OF THE INVENTION (a) Field of the Invention

The present invention relates to an electron emission device, and in particular, to an electron emission device with a grid electrode which focuses the electron beams emitted from the electron emission regions, and prevents the electron emission regions from being adversely influenced by the anode electric field.

(b) Description of Related Art

Generally, electron emission devices can be classified into two types. A first type uses a hot cathode as an electron emission source, and a second type uses a cold cathode as the electron emission source.

Also, in the second type electron emission devices, there are a field emitter array (FEA) type, a surface conduction emitter (SCE) type, a metal-insulator-metal (MIM) type, a metal-insulator-semiconductor (MIS) type, and a ballistic electron surface emitting (BSE) type.

Although the electron emission devices are differentiated in their specific structure depending upon the types thereof, they all basically have a vacuum structure formed by first and second substrates. Electron emission regions and driving electrodes are formed on the first substrate to emit electrons from the electron emission regions. Phosphor layers are formed on the second substrate together with an anode electrode for accelerating the electrons emitted from the electron emission regions toward the second substrate to emit light or display the desired images.

Assuming a case where the voltages applied to the driving electrodes on the first substrate are the same, the higher the voltage applied to the anode electrode, the more the screen brightness is enhanced. However, as the voltage applied to the anode electrode is elevated, the electron emission regions are influenced by the anode electric field, and electrons are emitted from the electron emission regions even at the off-state pixels where the electron emission should not be made, thereby causing mis-emission of light. Because of this, it has been proposed that a mesh-shaped grid electrode be provided between the first and second substrates with a plurality of beam-guide holes. The grid electrode functions both to shield the electron emission regions from the anode electric field, and to focus the electron beams emitted from the electron emission regions.

Typically, the grid electrode has one electron beam passage hole that corresponds to each of the respective pixel regions on the first substrate. However, with such a structure, it is very difficult to align the grid electrode between the first and second substrates in accordance with the alignment state of the first and second substrates such that the electron beam passage holes are located at their proper positions, and to assemble them with each other. Because of this, the method for assembling an electron emission device with the above described grid electrode is complicated and expensive.

Furthermore, the grid electrode primarily influences the trajectory of the electron beams depending upon its positional relation to the first and second substrates, and the voltages applied thereto. However, although the typical grid electrode may effectively shield the electron emission regions from the anode electric field, the electron beams passing through the typical grid electrode may be over-focused because the typical grid electrode is not optimized based upon its positional relation to the first and second substrates, and the voltages applied thereto, thereby deteriorating the screen image quality.

SUMMARY OF THE INVENTION

In one exemplary embodiment of the present invention, an electron emission device prevents the electron emission regions from being adversely influenced by the anode electric field to inhibit the mis-emission of light due to the anode electric field, and enables elevation of the anode voltage to enhance the screen brightness.

In another exemplary embodiment of the present invention, an electron emission device has a grid electrode that can be easily aligned to a first substrate and a second substrate and can prevent the trajectory of electron beams from being deviated, thereby enhancing the screen image quality.

In an exemplary embodiment of the present invention, an electron emission device includes first and second substrates facing each other and having a vacuum space interposed therebetween, an electron emission array formed on the first substrate to emit electrons toward the second substrate, and phosphor layers formed on the second substrate. An anode electrode is formed on a surface of the phosphor layers, and receives a voltage required for accelerating electron beams from the electron emission array. A grid electrode is disposed between the first and second substrates and is closer to the second substrate than to the first substrate. The grid electrode has electron beam passage holes, and receives a voltage lower than a location reference voltage.

In one embodiment, the distance between the grid electrode and the anode electrode is three or less times larger than the thickness of the grid electrode.

In one embodiment, the electron emission array includes cathode electrodes, electron emission regions electrically connected to the cathode electrodes, gate electrodes, and an insulating layer interposed between the cathode electrodes and the gate electrodes.

In one embodiment, the location reference voltage V is established to satisfy the following condition:

$$V=(Va-Vc)\times(1-(d+t)/D)$$

where Va indicates the voltage applied to the anode electrode, Vc indicates the voltage applied to at least one of the cathode electrodes, d indicates the distance between the grid electrode and the anode electrode, t indicates the thickness of the grid electrode, and D indicates the distance between the at least one of the cathode electrodes and the anode electrode.

In one embodiment, the grid electrode is formed with a metal plate having a plurality of electron beam passage holes, which are correspondingly formed at each of a plurality pixel regions defined on the first substrate.

DETAILED DESCRIPTION

Figure 1:
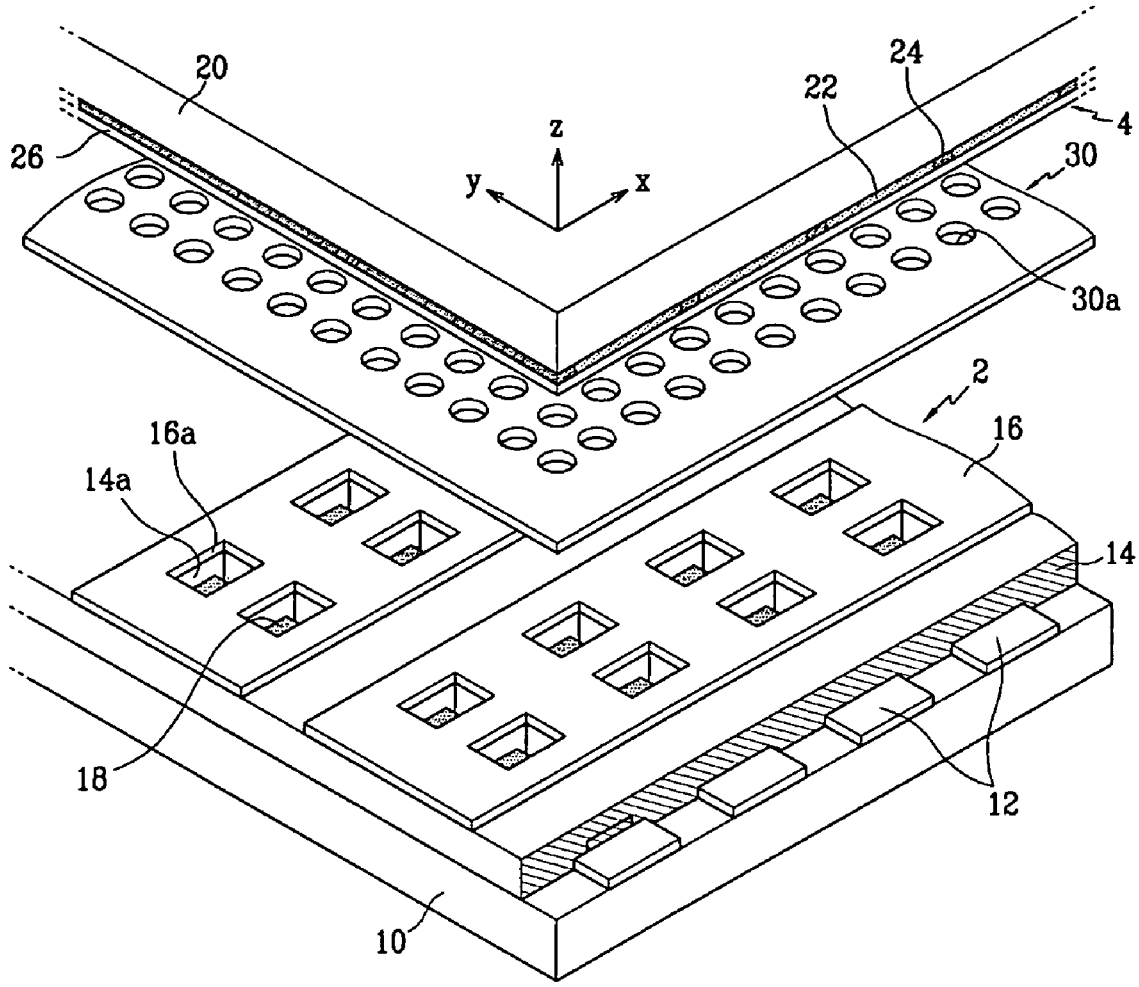
FIG. 1 is a partial exploded perspective view of an electron emission device according to an embodiment of the present invention.
Figure 2:
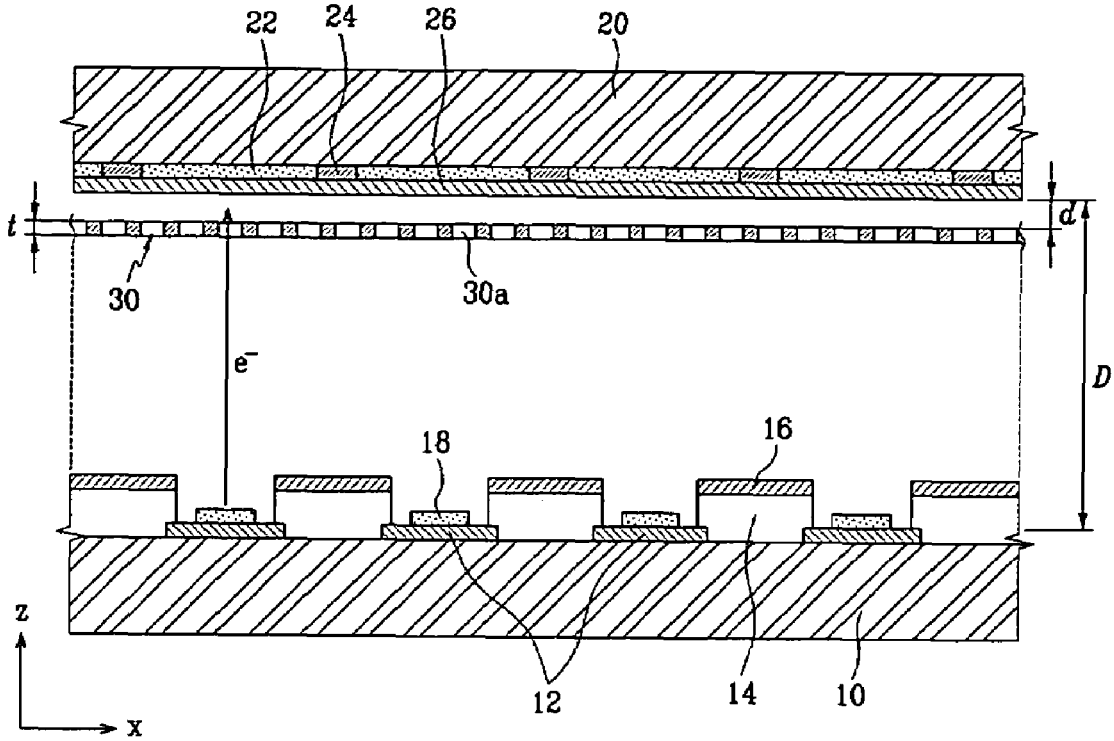
FIG. 2 is a partial sectional view of the electron emission device according to the embodiment of FIG. 1.

As shown in FIGS. 1 and 2, the electron emission device includes first and second substrates 10, 20 facing each with a predetermined distance therebetween to form a vacuum space. A grid electrode 30 is disposed between the substrates 10, 20. An electron emission array 2 is provided at the first substrate 10 to emit electrons toward the second substrate 20, and a light emission unit 4 is provided at the second substrate 20 to emit visible rays due to the electrons, and display the desired images.

Depending upon the type of the electron emission device, an electron emission array (e.g., the electron emission array 2) can have a different specific structure. The structure of the electron emission array 2 applied to an FEA-type electron emission device is shown in FIG. 1. However, the electron emission array of the present invention is not limited to the structure of FIG. 1, and may be altered in various manners.

Referring still to FIG. 1, a plurality of cathode electrodes 12 are formed on the first substrate 10 with a predetermined pattern, such as a stripe. The cathode electrodes 12 proceed in a first direction of the first substrate 10 (e.g., in an y-axis direction of FIG. 1) while being spaced apart from each other with a distance. An insulating layer 14 is formed on the entire area of the first substrate 10 to cover the cathode electrodes 12. A plurality of gate electrodes 16 are formed on the insulating layer 14. The gate electrodes 16 proceed in a second direction crossing the cathode electrodes 12 (e.g., in an x-axis direction of FIG. 1) while being spaced apart from each other with a distance.

In FIG. 1, the crossed regions of the cathode and gate electrodes 12, 16 can be used to define pixel regions. When the crossed regions of the cathode and the gate electrodes 12, 16 are used to define the pixel regions, opening portions 14*a*, 16*a* are formed on a gate electrode 16 and the insulating layer 14 at a respective pixel region to partially expose the surface of a cathode electrode 12. An electron emission region 18 is formed on the cathode electrode 12 within the opening portions 14*a*, 16*a*.

The electron emission region 18 is formed with a material for emitting electrons under the application of an electric field. The material can be formed from a carbonaceous material and/or a nanometer-sized material. In one embodiment, the electron emission region 8 is formed with carbon nanotube, graphite, graphite nanofiber, diamond, diamond-like carbon, $C_{60}$, and/or silicon nanowire. The electron emission region 18 can be made by a method such as direct growth, screen printing, chemical vapor deposition, and/or sputtering.

Figure 3:
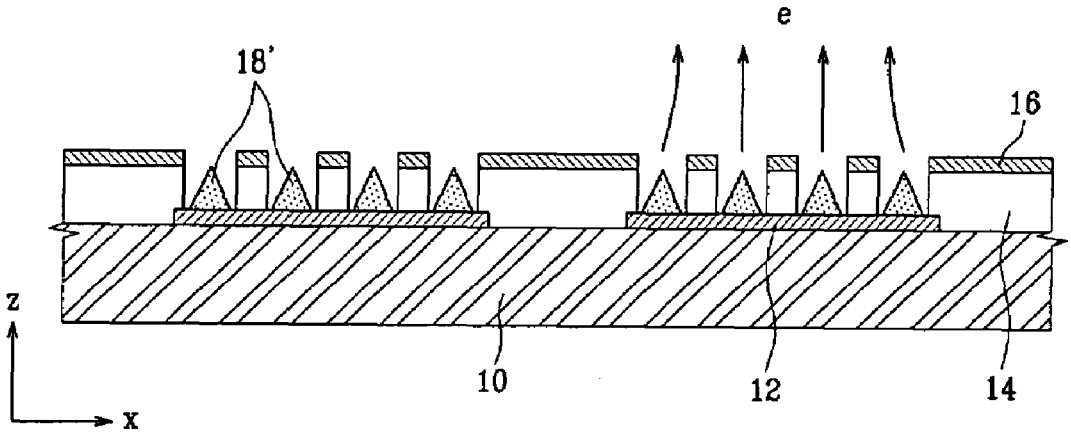
FIG. 3 is a partial sectional view for illustrating a variant of the electron emission region for an electron emission device.

Referring to FIG. 3, an electron emission region 18' can also be formed with a sharp front-ended cone tip using mainly molybdenum (Mo) and/or silicon (Si).

Figure 4:
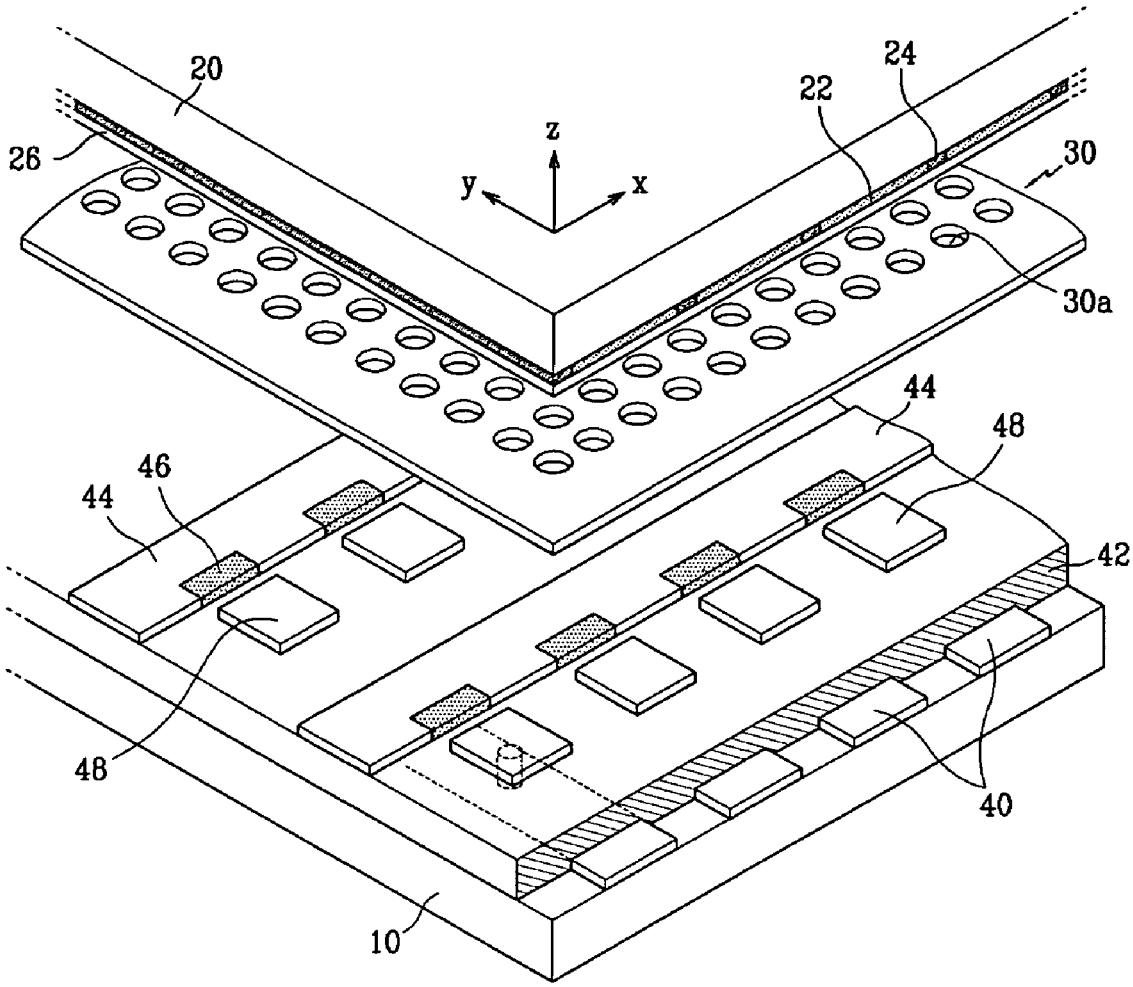
FIG. 4 is a partial exploded perspective for illustrating a variant of the electron emission array for an electron emission device.

FIGS. 1 to 3 illustrate the case where the gate electrodes 16 are placed over the cathode electrodes 12 while the insulating layer 14 is interposed therebetween. Alternatively, as shown in FIG. 4, a plurality of gate electrodes 40 are placed under a plurality of cathode electrodes 44 while an insulating layer 42 is interposed therebetween. In FIG. 4, an electron emission region 46 is formed along a side periphery (or a one-sided periphery) of an cathode electrode 44. A counter electrode 48 may also be formed apart from the electron emission region 46 with a distance while being electrically connected to a gate electrode 40.

Phosphor layers 22 and black layers 24 are formed on the surface of the second substrate 20 facing the first substrate 10, and an anode electrode 26 is formed on the phosphor layers 22 and the black layers 24 with a metallic layer (mainly, an aluminum-based layer formed through deposition). The anode electrode 26 receives the voltage required for accelerating the electron beams from an outside structure (not shown), and reflects the visible rays radiated toward the first substrate 10 to the second substrate 20, thereby heightening the screen brightness.

Alternatively, an anode electrode may be formed with a transparent conductive material, such as indium tin oxide (ITO). In this case, the anode electrode (not shown) is formed on the surface of the phosphor layers 22 and the surface of the black layers 24 that are facing the second substrate 20 while being partitioned into plural portions with a predetermined pattern.

Referring back to FIGS. 1 and 2, when predetermined driving voltages are applied to the cathode and gate electrodes 12, 16, electric fields are formed around the electron emission regions 18 due to the potential difference between the cathode and gate electrodes 12, 16 so that electrons are emitted from the electron emission regions 18. The emitted electrons are attracted toward the second substrate 20 by the high voltage applied to the anode electrode 26 (e.g., a positive (+) voltage from about several hundred to several thousand volts), and collide against the phosphor layers 22 at the relevant pixels, thereby light-emitting them.

A grid electrode 30 is disposed between the first and second substrates 10, 20 to prevent the electron emission regions 18 from being adversely influenced by the anode electric field. In this embodiment, the grid electrode 30 is placed closer to the second substrate 20 than to the first substrate 10, and receives a voltage lower than a location reference voltage. The location reference voltage refers to the voltage level which is naturally formed at a predetermined location between the first and second substrates 10, 20 due to the influence of the electrodes of the first and second substrates 10, 20.

The grid electrode 30 can be structured by forming a plurality of electron beam passage holes 30*a* at a thin metallic plate through mechanical processing or chemical etching. The beam passage holes 30*a* are shaped with a circle, but the shape of the beam passage holes of the present invention is not limited thereto.

In this embodiment, even though the final accelerating voltage applied to the anode electrode 26 is elevated to a predetermined level, the grid electrode 30 weakens the influential force of the anode electric field to the electron emission regions 18 so that the electron emission at the off-stated pixels is not made because the grid electrode 30 is placed close to the second substrate 20 with a potential lower than the anode potential. Consequently, in an electron emission device having a grid electrode of the present invention, the screen brightness is heightened, and the mis-emission of light is inhibited, thereby enhancing the screen image quality.

In more detail, referring still FIGS. 1, 2, 3, and 4, the distance between the grid electrode 30 and the second substrate 20 and the voltage applied to the grid electrode 30 are established to minimize deviation in the trajectory of electron beams, and to enhance the screen image quality.

Referring to FIG. 2, the distance d between the grid electrode 30 and the anode electrode 26 (d of FIG. 2) is established to be not less than three times larger than the thickness t of the grid electrode 30 (t of FIG. 2). That is, the grid electrode 30 is disposed at the location between the first and second substrates 10, 20, at the locations satisfying the following distance d and thickness t relationship:

$$d \leqq 3t$$

Furthermore, in consideration of the anode voltage Va of the anode electrode 26, the cathode voltage Vc of a cathode electrode 12, and the positional relation among the grid electrode 30, the anode electrode 26 and the cathode electrode 12, the voltage Vm applied to the grid electrode 30 in one embodiment of the present invention is established to satisfy the following relationship:

$$Vm<(Va-Vc)\times(1-(d+t)/D)$$

where D indicates the distance between the cathode and the anode electrodes 12, 26, and (Va−Vc)×(1−(d+t)/D) indicates the location reference voltage.

The above conditions are made to prevent the electron beams from being over-focused when they pass the grid electrode 30 (e.g., d≦3t), and to inhibit the intrusion of the anode electric field to the electron emission regions by way of the grid electrode 30 (e.g., Vm<(Va−Vc)×(1−(d+t)/D)), thereby preventing generation of the mis-emission of light. Because of this, an electron emission device having the grid electrode 30 inhibits enlargement of the beam diameter due to any possible over-focusing of the electron beams, thereby enhancing the screen image quality.

Figure 5:
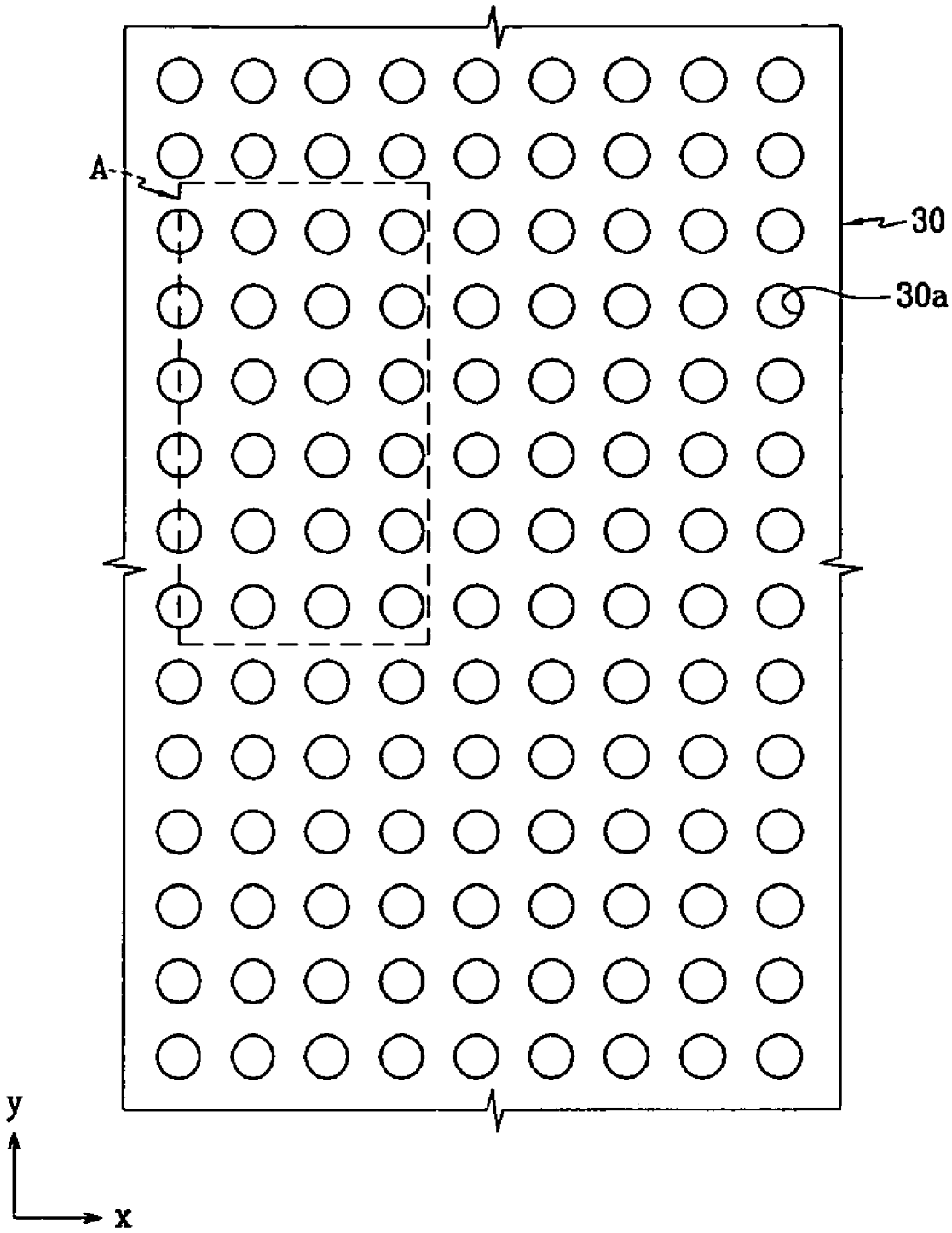
FIG. 5 is a partial plan view of a grid electrode.

Moreover, instead of the structure where the grid electrode 30 has one beam passage hole per each of the respective pixel regions on the first substrate 10, as shown in FIG. 5, the grid electrode has a net or mesh structure where two or more beam passage holes 30*a* are provided per a respective pixel region A.

The alignment error of the grid electrode 30 is determined depending upon the number of beam passage holes 30*a*. In one embodiment, when the size of the pixel region A in a horizontal direction or the vertical direction (or an x-axis direction or an y-axis direction of FIG. 5) of the screen is indicated by A1, and the number of beam passage holes 30*a* arranged at the pixel region A in the horizontal direction or the vertical direction of the screen is indicated by n, the horizontal or vertical alignment degree ϵ of the grid electrode 30 is expressed by the following relationship:

$$\epsilon=A1/2n$$

Assuming a case that the size of a pixel region measured in a horizontal direction of a screen is about several hundred micrometers, at least three or more beam passage holes should be provided at the pixel region in the horizontal and/or vertical directions of the screen to maintain the horizontal and/or vertical alignment degrees of the grid electrode to be within a range of from ten to several ten micrometers without performing any special alignment process. Accordingly, the grid electrode 30 has three or more beam passage holes 30*a* per the respective pixel region A defined on the first substrate 10 in the horizontal and/or vertical directions of the screen.

With the above structure, the degree of alignment between the grid electrode 30 and the first substrate 10 does not influence the light emission characteristic of the device, and the alignment of the grid electrode 30 to the first substrate is easily made.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

first and second substrates facing each other and having a vacuum space interposed therebetween;

an electron emission array formed on the first substrate to emit electrons toward the second substrate;

a plurality of phosphor layers formed on the second substrate;

an anode electrode formed on a surface of the phosphor layers and receiving a voltage required for accelerating electron beams from the electron emission array; and a grid electrode disposed between the first and second substrates, the grid electrode being closer to the second substrate than to the first substrate, the grid electrode having a plurality of electron beam passage holes, and receiving a voltage lower than a location reference voltage at the location of the grid electrode due to a voltage applied to the electron emission array and the voltage applied to the anode electrode, wherein the grid electrode has a plurality of electron beam passage holes for each of a plurality of electron emission regions of the electron emission array, and wherein the grid electrode satisfies the following condition:

$$d \leqq 3t$$

where d indicates a distance between the grid electrode and the anode electrode, and t indicates a thickness of the grid electrode.

2. The electron emission device of claim 1 wherein the electron emission array comprises a plurality of cathode electrodes, a plurality of electron emission regions electrically connected to the cathode electrodes, a plurality of gate electrodes, and an insulating layer interposed between the cathode electrodes and the gate electrodes.

3. The electron emission device of claim 2 wherein the ocation reference voltage V satisfies the following condition:

$$V=(Va-Vc)\times(1-(d+t)/D)$$

where Va indicates the voltage applied to the anode electrode, Vc indicates the voltage applied to at least one of the cathode electrodes, d indicates the distance between the grid electrode and the anode electrode, t indicates the thickness of the grid electrode, and D indicates the distance between the at least one of the cathode electrodes and the anode electrode.

4. The electron emission device of claim 2 wherein the electron emission regions comprise a material selected from the group consisting of carbon nanotube, graphite, graphite nanofiber, diamond, diamond-like carbon, $C_{60}$, silicon nanowire, and combinations thereof.

5. The electron emission device of claim 2 wherein the cathode electrodes are placed between the first substrate and the gate electrodes, and the insulating layer is interposed between the gate electrodes and the cathode electrodes, and a plurality of opening portions are formed at the gate electrodes and the insulating layer, at least one of the electron emission regions being placed on at least one of the cathode electrodes within at least one of the opening portions.

6. The electron emission device of claim 2 wherein the gate electrodes are placed between the first substrate and the cathode electrodes, and the insulating layer is interposed between the gate electrodes and the cathode electrodes, and at least one of the electron emission regions is placed at a periphery side of at least one of the cathode electrodes.

7. The electron emission device of claim 1 wherein the grid electrode has three or more electron beam passage holes for each of the electron emission regions while proceeding in a direction selected from the group consisting of a horizontal direction and a vertical direction of a screen of the electron emission device.

8. The electron emission device of claim 1 wherein the electron emission array comprises a plurality of cathode electrodes, a plurality of gate electrodes, and an insulating layer interposed between the cathode electrodes and the gate electrodes and wherein the electron emission regions are electrically connected to the cathode electrodes crossing the gate electrodes.

9. The electron emission device of claim 1 wherein the grid electrode is formed with a metal plate having a plurality of electron beam passage holes.

10. An electron emission device comprising:

first and second substrates facing each other and having a vacuum space interposed therebetween;

an electron emission array having a plurality of cathode electrodes formed on the first substrate, a plurality of electron emission regions electrically connected to the cathode electrodes to emit electrons toward the second substrate, and a plurality of gate electrodes insulated from the cathode electrodes;

a plurality of phosphor layers formed on the second substrate;

an anode electrode formed on a surface of the phosphor layers and receiving a voltage required for accelerating electron beams from the electron emission regions; and a grid electrode disposed between the first and second substrates and having a plurality of electron beam passage holes;

wherein the grid electrode is placed closer to the second substrate than to the first substrate to reduce an over-focused effect, and wherein the grid electrode receives a medium-level voltage, the medium-level voltage being lower than a location reference voltage at the location of the grid electrode due to a voltage applied to at least one of the cathode electrodes and the voltage applied to the anode electrode to reduce an influential force of an electric field of the anode electrode to the electron emission regions, wherein the grid electrode has a plurality of electron beam passage holes for each of a plurality of electron emission regions of the electron emission array, and wherein the grid electrode satisfies the following condition:

$$d \leqq 3t$$

where d indicates a distance between the grid electrode and the anode electrode, and t indicates a thickness of the grid electrode. ,

11. The electron emission device of claim 10 wherein the grid electrode satisfies the following condition:

$$Vm < (Va - Vc) \times (1 - (d+t)/D)$$

where Vm indicates the voltage applied to the grid electrode, Va indicates the voltage applied to the anode electrode, Vc indicates the voltage applied to at least one of the cathode electrodes, d indicates the distance between the grid electrode and the anode electrode, t indicates the thickness of the grid electrode, and D indicates the distance between the at least one of the cathode electrodes and the anode electrode.

12. The electron emission device of claim 10 wherein the grid electrode has three or more electron beam passage holes for each of the electron emission regions while proceeding a direction selected from the group consisting of a horizontal direction and a vertical direction of a screen of the electron emission device.

13. An electron emission device comprising:

first and second substrates facing each other and having a vacuum space interposed therebetween;

an electron emission array formed on the first substrate to emit electrons toward the second substrate;

a plurality of phosphor layers formed on the second substrate;

an anode electrode formed on a surface of the phosphor layers and receiving a voltage required for accelerating electron beams from the electron emission array; and a grid electrode disposed between the first and second substrates, the grid electrode being closer to the second substrate than to the first substrate, the grid electrode having a plurality of electron beam passage holes, and receiving a voltage lower than a location reference voltage at the location of the grid electrode due to a voltage applied to the electron emission array and the voltage applied to the anode electrode, wherein the grid electrode satisfies the following condition to inhibit over-focusing of the electrons emitted from the electron emission array and passing through the grid electrode:

$$d \leqq 3t$$

where d indicates a distance between the grid electrode and the anode electrode, and t indicates a thickness of the grid electrode.

* * * * *

UNITED STATES PATENT AND TRADEMARK OFFICE

CERTIFICATE OF CORRECTION

PATENT NO. : 7,548,018 B2
APPLICATION NO. : 11/212836
DATED : June 16, 2009
INVENTOR(S) : Seung-Hyun Lee It is certified that error appears in the above-identified patent and that said Letters Patent is hereby corrected as shown below:

In the Claims

| | |
|---|---|
| Column 6, Claim 3, line 38 | Delete "ocation" Insert -- location -- |
| Column 8, Claim 10, line 4 | After "electrode." Delete "," |

Signed and Sealed this
Twelfth Day of April, 2011

David J. Kappos

David J. Kappos
*Director of the United States Patent and Trademark Office*